US009685703B2

(12) United States Patent
Kao et al.

(10) Patent No.: US 9,685,703 B2
(45) Date of Patent: Jun. 20, 2017

(54) TUNABLE ANTENNA

(71) Applicants: Yeh-Chun Kao, Taipei (TW); You-Fu Cheng, Taipei (TW); Yu-Chia Chang, Taipei (TW)

(72) Inventors: Yeh-Chun Kao, Taipei (TW); You-Fu Cheng, Taipei (TW); Yu-Chia Chang, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 155 days.

(21) Appl. No.: 14/548,310

(22) Filed: Nov. 20, 2014

(65) Prior Publication Data

US 2015/0145744 A1 May 28, 2015

(30) Foreign Application Priority Data

Nov. 28, 2013 (TW) ..... 102143486 A

(51) Int. Cl.

| | |
|---|---|
| ***H01Q 3/24*** | (2006.01) |
| ***H01Q 5/321*** | (2015.01) |
| ***H01Q 9/04*** | (2006.01) |
| ***H01Q 9/42*** | (2006.01) |
| ***H01Q 21/30*** | (2006.01) |
| ***H01Q 5/371*** | (2015.01) |
| ***H01Q 5/378*** | (2015.01) |

(52) U.S. Cl.

CPC ..... *H01Q 5/321* (2015.01); *H01Q 5/371* (2015.01); *H01Q 5/378* (2015.01); *H01Q 9/0421* (2013.01); *H01Q 9/42* (2013.01); *H01Q 21/30* (2013.01)

(58) Field of Classification Search

CPC ..... H01Q 3/24; H01Q 21/28; H01Q 1/243; H01Q 1/38

USPC ..... 343/876, 725, 904, 846

See application file for complete search history.

(56) References Cited

U.S. PATENT DOCUMENTS 6,662,028 B1 * 12/2003 Hayes ..... H01Q 1/243 343/908

2011/0128200 A1 * 6/2011 Hossain ..... H01Q 7/00 343/745

(Continued)

FOREIGN PATENT DOCUMENTS

| | | |
|---|---|---|
| CN | 102760952 | 10/2012 |
| TW | 201034292 | 9/2010 |

*Primary Examiner* — Dameon E Levi
*Assistant Examiner* — Collin Dawkins
(74) *Attorney, Agent, or Firm* — Jianq Chyun IP Office

(57) ABSTRACT

A tunable antenna including a first radiating element, a second radiating element, a connection circuit and a switch circuit is provided. The first radiating element includes a coupling portion and a first feeding portion. The second radiating element includes a second feeding portion, a grounding portion and a radiation portion. The grounding portion is electrically connected to a ground plane, and the radiation portion surrounds the coupling portion to form a first coupling gap and the second coupling gap. The connection circuit is electrically connected to the radiation portion and a state of the connection circuit is changed according to a control signal, so as to adjust a length of the resonant path of the radiation portion. A feeding signal is transmitted to the first feeding portion or the second feeding portion by the switch circuit.

15 Claims, 5 Drawing Sheets

(56) References Cited

U.S. PATENT DOCUMENTS

| | | | | |
|---|---|---|---|---|
| 2012/0154247 | A1* | 6/2012 | Braun | H01Q 9/42 343/876 |
| 2013/0127677 | A1 | 5/2013 | Lin et al. | |
| 2013/0257659 | A1 | 10/2013 | Darnell et al. | |
| 2013/0257679 | A1 | 10/2013 | Wong et al. | |

* cited by examiner

TUNABLE ANTENNA

CROSS-REFERENCE TO RELATED APPLICATION

This application claims the priority benefit of Taiwan application serial No. 102143486, filed on Nov. 28, 2013. The entirety of the above-mentioned patent application is hereby incorporated by reference herein and made a part of specification.

BACKGROUND OF THE INVENTION

Field of the Invention

The invention relates to an antenna and, more particularly, to a tunable antenna.

Description of the Related Art

As communication technology develops, wireless communication devices are widely used in daily life. Moreover, the wireless communication standards of communication bands around the world are different. Consequently, the antenna for the wireless communication devices should support different wireless communication standards, and then the antenna of the wireless communication devices can receive or transmit multiband radio signals.

However, since the wireless communication devices gradually becomes smaller and thinner, the occupation space for the antenna in the wireless communication devices is limited.

BRIEF SUMMARY OF THE INVENTION

A tunable antenna using a switch circuit or a switchover element to select a feeding mode of the antenna is provided. Thus, the tunable antenna is miniaturized, and it also can operate at broadband and multiband.

The tunable antenna includes a first radiating element, a second radiating element, a connection circuit and a switch circuit. The first radiating element includes a coupling portion and a first feeding portion. The second radiating element includes a second feeding portion, a grounding portion and a radiation portion. The grounding portion is electrically connected to a ground plane, and the radiation portion surrounds the coupling portion to form a first coupling gap and a second coupling gap. The connection circuit is electrically connected to the radiation portion, and a state of the connection circuit is changed according to a control signal, so as to adjust a length of the resonant path of the radiation portion. A feeding signal is transmitted to the first feeding portion or the second feeding portion by the switch circuit.

In an embodiment, a tunable antenna includes a first radiating element, a second radiating element and a switchover element. The first radiating element includes a coupling portion and a first feeding portion. The first feeding portion is electrically connected to a feeding signal. The second radiating element is electrically connected to a ground plane, and it surrounds the coupling portion to form a first coupling gap and a second coupling gap. The switchover element is electrically connected between a first radiating element and a second radiating element, and it determines whether to conduct the first radiating element and the second radiating element according to a control signal.

The switch circuit or the switchover element is used for selecting the feeding mode of the antenna in the invention.

Thus, the tunable antenna can generate a plurality of different resonant modes, and then the antenna can operate at broadband and multiband.

BRIEF DESCRIPTION OF THE DRAWINGS

These and other features, aspects and advantages of the invention will become better understood with regard to the following embodiments and accompanying drawings.

DETAILED DESCRIPTION OF THE EMBODIMENTS

Figure 1:
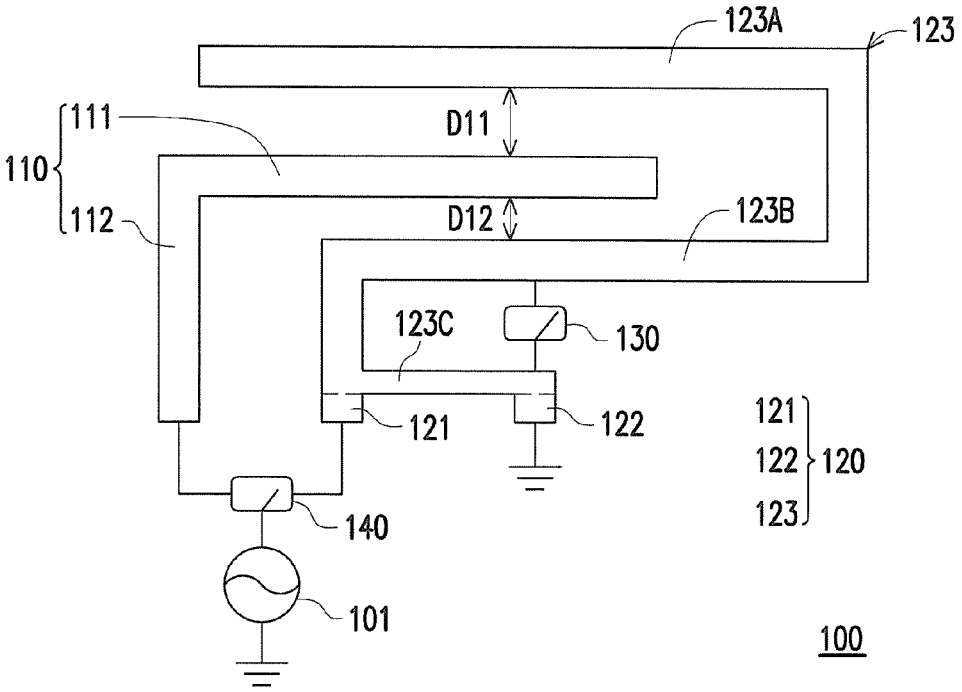
FIG. 1 is a schematic diagram showing the structure of a tunable antenna in the first embodiment.

FIG. 1 is a schematic diagram showing the structure of a tunable antenna in the first embodiment. Please refer to FIG. 1; a tunable antenna 100 includes a first radiating element 110, a second radiating element 120, a connection circuit 130 and a switch circuit 140. The first radiating element 110 is L-shaped, and it includes a coupling portion 111 and a first feeding portion 112. The second radiating element 120 includes a second feeding portion 121, a grounding portion 122 and a radiation portion 123.

The grounding portion 122 is electrically connected to a ground plane. The radiation portion 123 surrounds the coupling portion 111 of the first radiating element 110 to form a first coupling gap D11 and a second coupling gap D12. For example, the radiation portion 123 includes a plurality of bends to form a plurality of segments. The segments are electrically connected, and the segments include a first segment 123A, a second segment 123B and a third segment 123C, and the first segment 123A are parallel to the second segment 123B and third segment 123C. The first segment 123A and the second segment 123B are disposed at two sides of the coupling portion 111, respectively. The third segment 123C is electrically connected to the second feeding portion 121 and the grounding portion 122. Moreover, the first segment 123A and the coupling portion 111 are separated by the first coupling gap D11, and the second segment 123B and the coupling portion 111 are separated by the second coupling gap D12.

The connection circuit 130 is electrically connected to the radiation portion 123, and it changes a state of the connection circuit 130 according to a control signal to adjust a length of the resonant path of the radiation portion 123. For example, the connection circuit 130 may be a first switching element with two terminals. The first terminal of the first switching element is electrically connected to the second segment 123B, and the second terminal of the switching element is electrically connected to the third segment 123C. Furthermore, the first switching element determines whether to conduct its two terminals according to the control signal, and the state of the connection circuit 130 is changed accordingly. Thus, the second segment 123B can be selectively conducted to the third segment 123C via the connection circuit 130.

For example, if the first switching element is conducted, the transmission path between the second segment 123B and the third segment 123C is formed, and thus the connection circuit 130 conducts the second segment 123B and the third segment 123C. Conversely, if the first switching element is not conducted, the connection circuit 130 cannot provide the transmission path between the second segment 123B and the third segment 123C, and thus the connection circuit 130 cannot make the second segment 123B and the third segment 123C conduct. In other words, the connection circuit 130 determines whether to conduct the second segment 123B and the third segment 123C according to the control signal, so as to adjust the length of the resonant path of the radiation portion 123.

The switch circuit 140 can transmit a feeding signal 101 to the first feeding portion 112 or the second feeding portion 121. For example, the switch circuit 140 may be a second switching element including three terminals. The first terminal of the second switching element is electrically connected to the feeding signal 101, the second terminal of the second switching element is electrically connected to the first feeding portion 112, and the third terminal of the second switching element is electrically connected to the second feeding portion 121. Moreover, the second switching element conducts the first terminal to the second terminal or the third terminal according to a signal, so as to transmit the feeding signal 101 to the first feeding portion 112 or the second feeding portion 121 via the switch circuit 140.

In other words, the tunable antenna 100 can select the feeding mode via the switch circuit 140, and the resonant path of the connection circuit 130 is adjusted via the radiation portion 123. Thus, the tunable antenna 100 generates a plurality of different resonant modes, and thus the antenna can operate at broadband and multiband.

Figure 2:
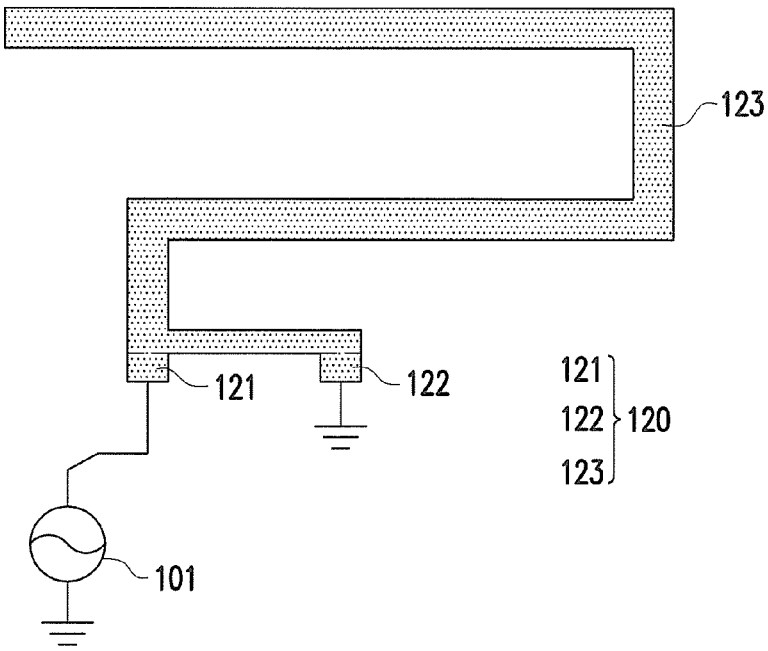
FIG. 2 and FIG. 3 are schematic diagrams showing the tunable antenna of FIG. 1 in different feeding modes.
Figure 3:
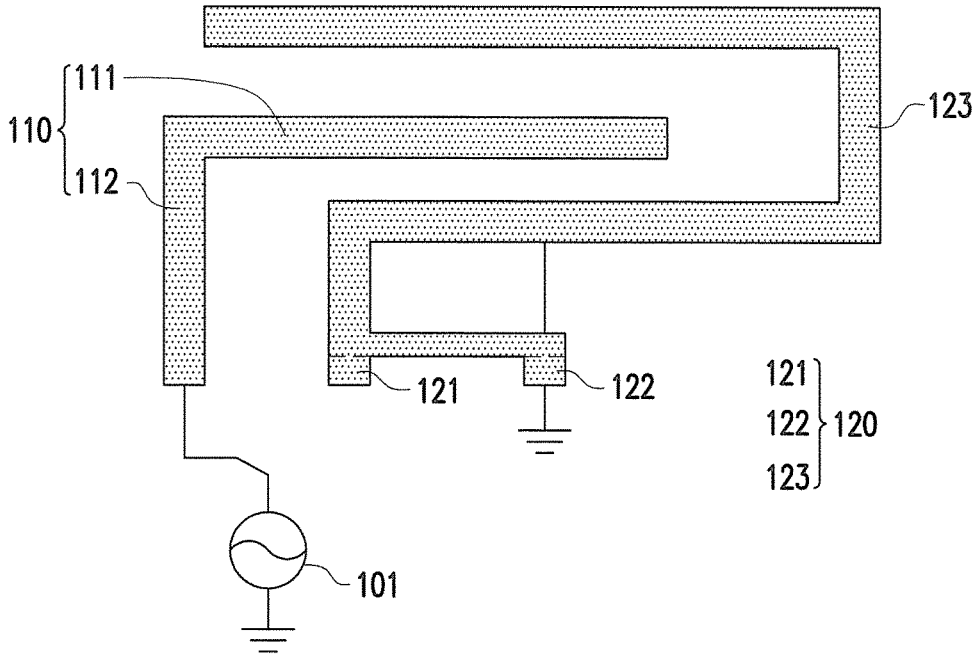

For example, FIG. 2 and FIG. 3 are schematic diagrams showing the tunable antenna of FIG. 1 in different feeding modes. In the first feeding mode, as shown in FIG. 2, the switch circuit 140 transmits the feeding signal 101 to the second feeding portion 121, and the connection circuit 130 does not conduct the second segment 123B and the third segment 123C. Thus, the tunable antenna 100 generates the first resonant mode via the second radiating element 120.

In the second feeding mode, as shown in FIG. 3, the switch circuit 140 transmits the feeding signal 101 to the first feeding portion 112, and the connection circuit 130 conducts the second segment 123B and the third segment 123C. In this case, the first radiating element 110 generates the second resonant mode via the feeding signal 101. Moreover, the feeding signal 101 from the first radiating element 110 is electromagnetically coupled to the second radiating element 120 via the first coupling gap D11 and the second coupling gap D12, and then the tunable antenna 100 generates the third resonant mode. In other words, in the second feeding mode, the tunable antenna 100 generates the second resonant mode and the third resonant mode via the first radiating element 110 and the second radiating element 120, respectively.

The tunable antenna 100 can cover a first operating band via the first resonant mode, and the tunable antenna 100 can cover a high frequency band and a second operating band via the second resonant mode and the third resonant mode. Furthermore, in the first feeding mode, as shown in FIG. 2, the tunable antenna 100 is directly fed, which improves the radiant efficiency of the tunable antenna 100 at the first operating band. Moreover, in the second feeding mode, as shown in FIG. 3, the tunable antenna 100 is coupling fed, which increases the bandwidth of the tunable antenna 100 at the high frequency band.

Moreover, in different feeding modes, the tunable antenna 100 makes the radiation portion 123 provide the resonant paths with different lengths via the connection circuit 130, and then the first resonant mode is different from the third resonant mode. Correspondingly, since the first operating band of the tunable antenna is different from the second operating band, the tunable antenna 100 can operate at multiband. In practice, the tunable antenna 100 can also provide the same resonant path of the radiation portions 123 in different feeding modes, so as to make the first resonant mode the same with the third resonant mode.

Figure 4:
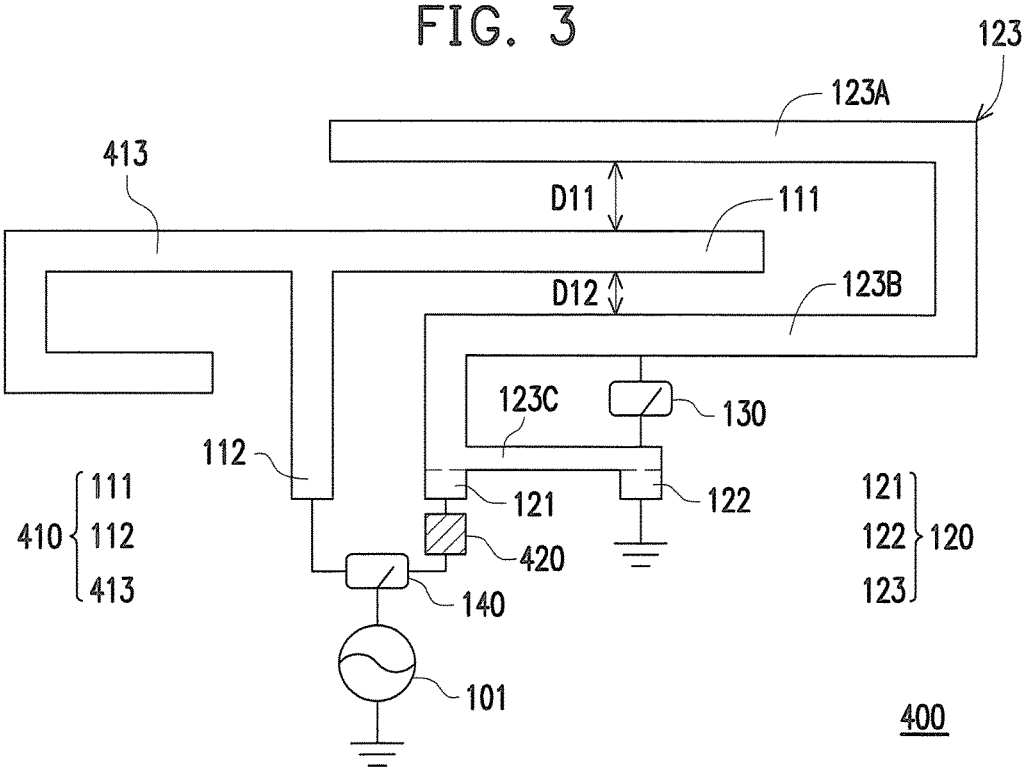
FIG. 4 is a schematic diagram showing the structure of a tunable antenna in the second embodiment.

FIG. 4 is a schematic diagram showing the structure of a tunable antenna in the second embodiment. The tunable antenna 400 shown in FIG. 4 is similar to the tunable antenna 100 shown in FIG. 1. In the embodiment, the difference between FIG. 1 and FIG. 4 is that the tunable antenna 400 further includes a coupling element 420, and the first radiating element 410 is T-shaped.

In detail, the first radiating element 410 includes a coupling portion 111, a first feeding portion 112 and an extending portion 413, and the coupling portion 111, the first feeding portion 112 and the extending portion 413 form a T shape. The extending portion 413 includes at least a bend, so as to reduce the space for the first radiating element 410. The coupling element 420 is electrically connected between the second feeding portion 121 and the switch circuit 140. The coupling element 420 is used for adjusting the impedance matching between the second feeding portion 121 and the switch circuit 140, so as to improve the transmission efficiency of the tunable antenna 400. The coupling element 420 may be a passive device, such as an inductor, a capacitor and a transmission line, which is not limited herein.

Similar to the embodiment in FIG. 1, in the first feeding mode, the tunable antenna 400 generates the first resonant mode via the second radiating element 120 to cover the first operating band. In the second feeding mode, the tunable antenna 400 generates the second resonant mode and the third resonant mode via the first radiating element 410 and the second radiating element 120, respectively, to cover the high frequency band and the second operating band.

Figure 5:
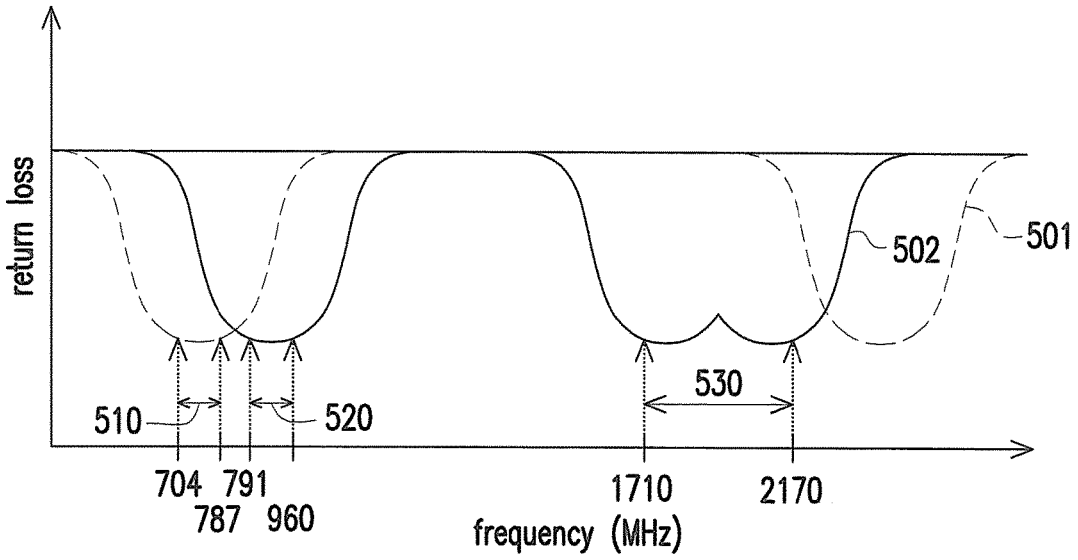
FIG. 5 is a diagram showing the turn loss of the tunable antenna in FIG. 4.

FIG. 5 is a diagram showing the return loss of the tunable antenna in FIG. 4. The return loss curve (the dashed line) 501 shows the return loss of the tunable antenna 400 in the first feeding mode, the return loss curve (the solid line) 502 shows the return loss of the tunable antenna 400 in the second feeding mode. As shown in the return loss curves 501 and 502, the tunable antenna 400 can cover the first operating band 510 in the first feeding mode, and the tunable antenna 400 can cover the second operating band 520 and the third operating band 530 in the second feeding mode.

Figure 6:
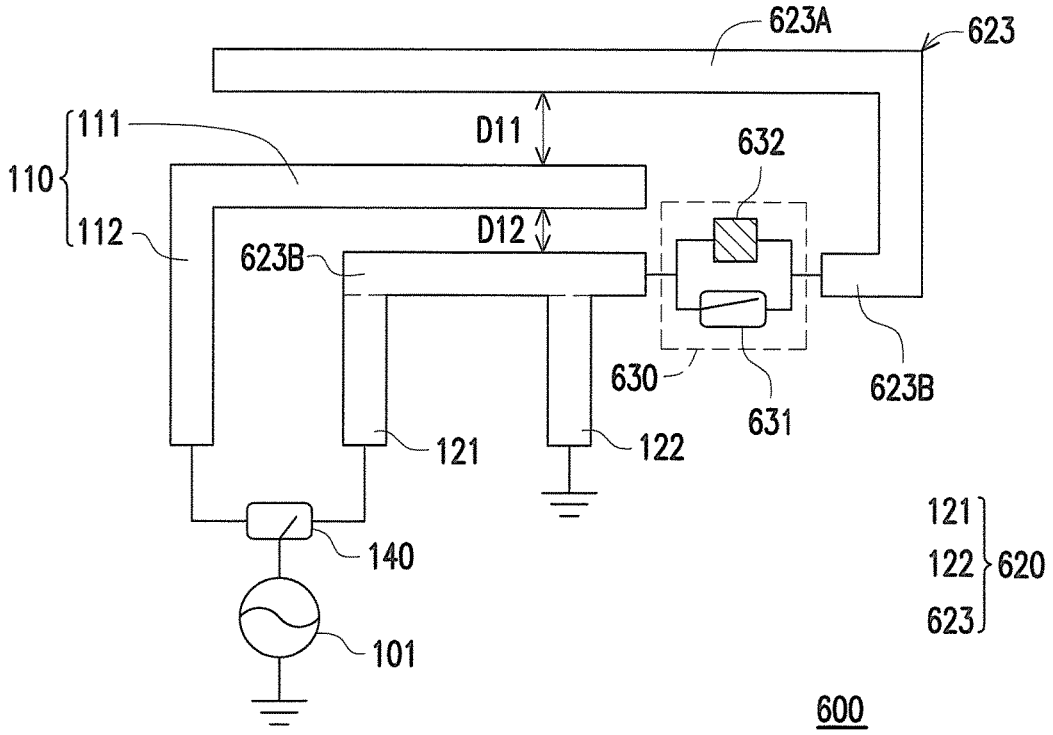
FIG. 6 is a schematic diagram showing the structure of the tunable antenna in the third embodiment.

FIG. 6 is a schematic diagram showing the structure of the tunable antenna in the third embodiment. The tunable antenna 600 shown in FIG. 6 is similar to the tunable antenna 100 shown in FIG. 1. In the embodiment, the difference between FIG. 1 and FIG. 6 is that the radiation portion 623 of the second radiating element 620 includes a first segment 632A and a second segment 632B. The first segment 632A is parallel to the second segment 632B, and the connection circuit 630 is inserted in the second segment 632.

In detail, the first segment 632A and the coupling portion 111 are separated by the first coupling gap D11, and the second segment 632B and the coupling portion 111 are separated by the second coupling gap D12. Furthermore, the second segment 632B is electrically connected to the second feeding portion 121 and the grounding portion 122. Moreover, the connection circuit 630 includes a switching element 631 and a coupling element 632, and the switching element 631 is connected to the coupling element 632 in parallel.

In practice, the tunable antenna 600 can adjust the resonant path of the radiation portion 623 via the connection circuit 630. For example, if the switching element 631 is conducted, the current generated by the radiation portion 632 flows through the switching element 631 of the connection circuit 630. In contrast, if the switching element 631 is not conducted, the current generated by the radiation portion 632 flows through the coupling element 632 of the connection circuit 630, and thus the radiation portion 623 can use the coupling element 632 to extend the length of the resonant path. The coupling element 632 may be a passive element, such as an inductor, a capacitor and a transmission line, which is not limited herein.

Similar to the embodiment in FIG. 1, in the first feeding mode, the tunable antenna 600 generates the first resonant mode to cover the first operating band. In the second feeding mode, the tunable antenna 600 generates the second resonant mode and the third resonant mode to cover the high frequency band and the second operating band.

For example, in the first feeding mode, the switch circuit 140 transmits the feeding signal 101 to the second feeding portion 121, and the switching element 631 of the connection circuit 630 is not conducted. In this case, the tunable antenna 600 generates the first resonant mode via the second radiating element 620 and the coupling element 632 to cover the first operating band. In the second feeding mode, the switch circuit 140 transmits the feeding signal 101 to the first feeding portion 112, and the connection circuit 630 of the switching element 631 is conducted. In this case, the first radiating element 110 generates the second resonant mode to cover the high frequency band under the exciting by the feeding signal 101. Furthermore, the feeding signal 101 from the first radiating element 110 is coupled to the second radiating element 620 via the first coupling gap D11 and the second coupling gap D12, and then the tunable antenna 600 generates the third resonant mode to cover the second operating band.

Figure 7:
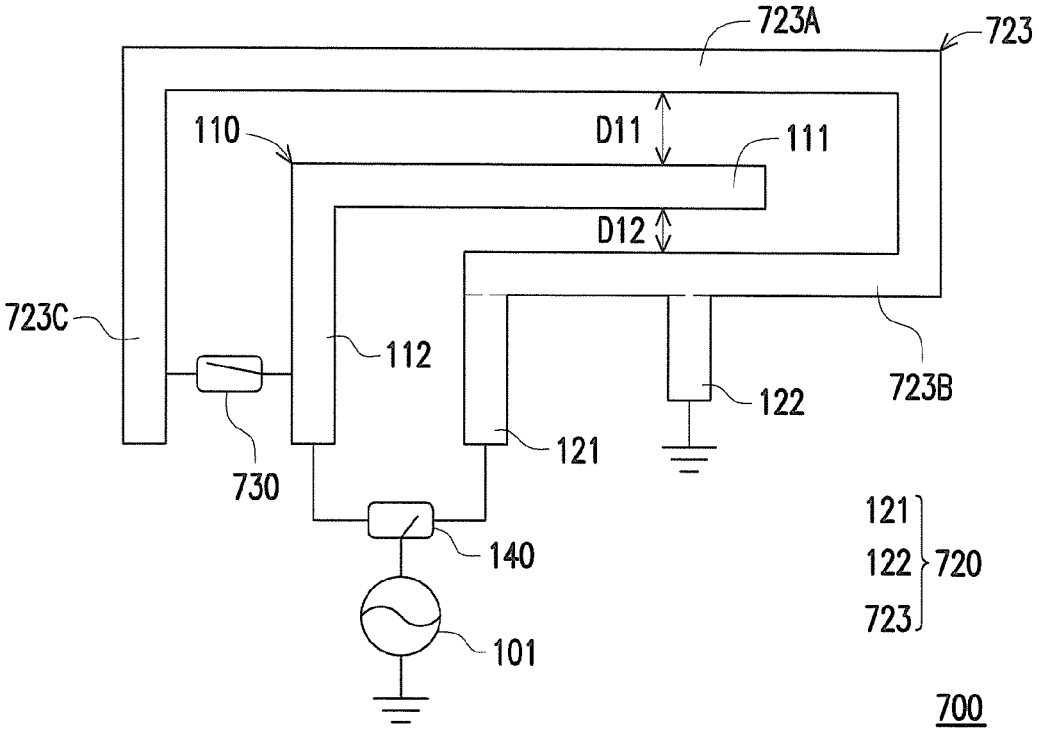
FIG. 7 is a schematic diagram showing the structure of the tunable antenna in the fourth embodiment.

FIG. 7 is a schematic diagram showing the structure of the tunable antenna in the fourth embodiment. The tunable antenna 700 shown in FIG. 7 is similar to the tunable antenna 100 shown in FIG. 1. In the embodiment, the difference between FIG. 1 and FIG. 7 is that the radiation portion 723 of the second radiating element 720 includes a first segment 723A, a second segment 723B and a third segment 723C, and the connection circuit 730 is electrically connected between the third segment 723C and the first feeding portion 112.

In detail, the first segment 723A is parallel to the second segment 723B. The second segment 723B is electrically connected to the second feeding portion 121 and the grounding portion 122, and the third segment 723C is electrically connected to the first segment 723A. Furthermore, the first segment 723A and the coupling portion 111 are separated by the first coupling gap D11, and the second segment 723B and the coupling portion 111 are separated by the second coupling gap D12.

In practice, the connection circuit 730 determines whether to conduct the first radiating element 110 and the second radiating element 720 according to the control signal, and then the tunable antenna 700 can adjust the resonant path of the radiation portion 723 via the connection circuit 730. Similar to FIG. 1, in the first feeding mode, the tunable antenna 700 generates the first resonant mode to cover the first operating band. In the second feeding mode, the tunable antenna 700 generates the second resonant mode and the third resonant mode to cover the high frequency band and the second operating band.

Figure 8:
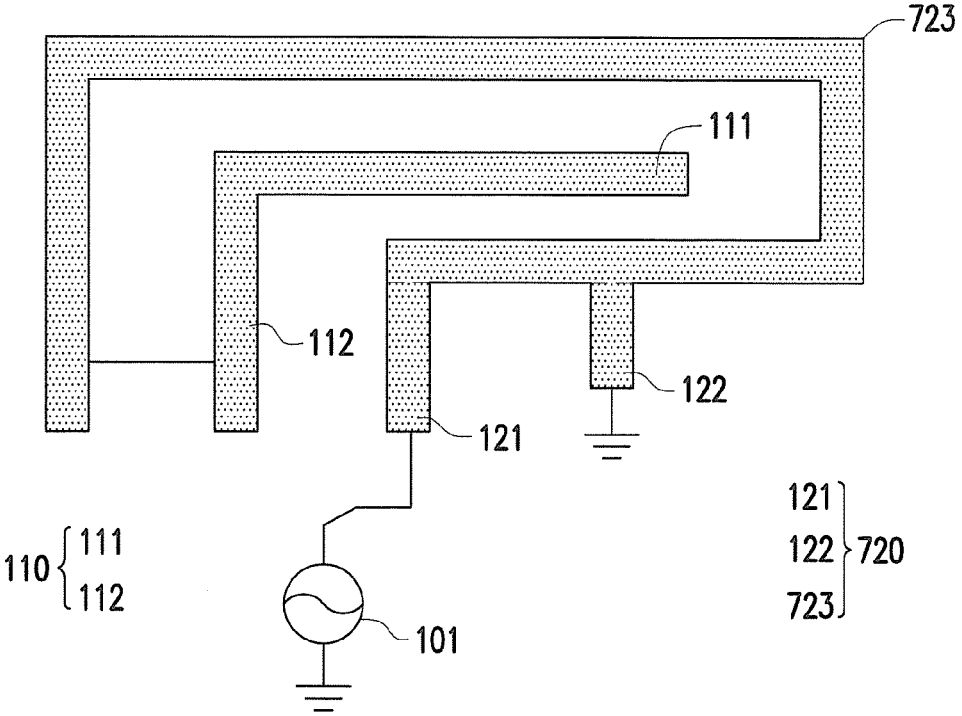
FIG. 8 and FIG. 9 are schematic diagrams showing the tunable antenna of FIG. 7 in different feeding modes.
Figure 9:
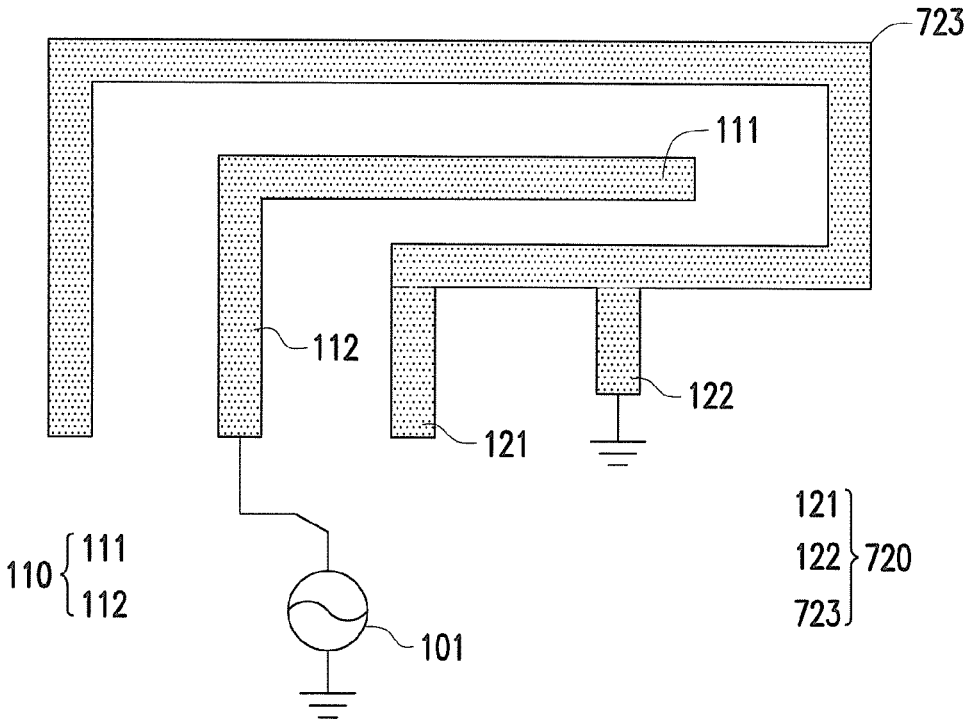

For example, FIG. 8 and FIG. 9 are schematic diagrams showing the tunable antenna of FIG. 7 in different feeding modes. In the first feeding mode, as shown in FIG. 8, the switch circuit 140 transmits the feeding signal 101 to the second feeding portion 121, and the connection circuit 730 conducts the first radiating element 110 and the second radiating element 720. In this case, the tunable antenna 700 extends the length of the resonant path of the radiation portion 723 via the first radiating element 110. Thus, the tunable antenna 700 generates the first resonant mode via the first radiating element 110 and the second radiating element 720 to cover the first operating band.

In the second feeding mode, as shown in FIG. 9, the switch circuit 140 transmits the feeding signal 101 to the first feeding portion 112, and the connection circuit 730 does not conduct the first radiating element 110 and the second radiating element 720. In this case, the first radiating element 110 generates the second resonant mode through the exciting of the feeding signal 101 to cover the high frequency band. The first radiating element 110 from the feeding signal 101 is coupled to the second radiating element 720 via the first coupling gap D11 and the second coupling gap D12, and then the tunable antenna 100 generates the third resonant mode to cover the second operating band.

Figure 10:
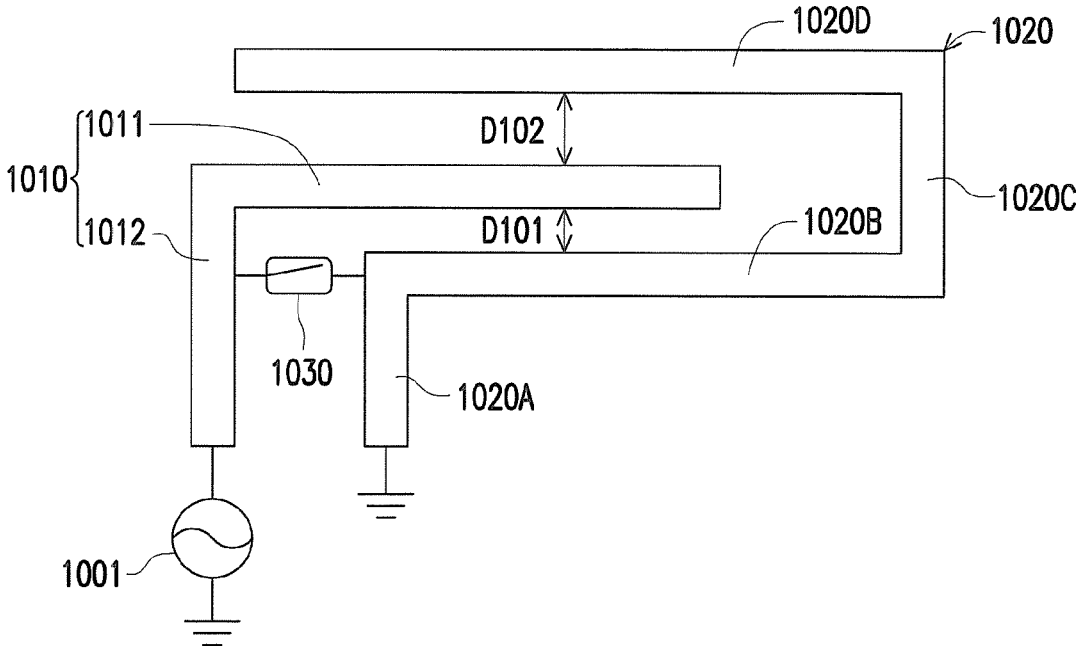
FIG. 10 is a schematic diagram showing the structure of the tunable antenna in the fifth embodiment.

FIG. 10 is a schematic diagram showing the structure of the tunable antenna in a fifth embodiment. Please refer to FIG. 10; a tunable antenna 1000 includes a first radiating element 1010, a second radiating element 1020 and a switchover element 1030. The first radiating element 1010 includes a coupling portion 1011 and a first feeding portion 1012, and the first feeding portion 1012 of the first radiating element 1010 is electrically connected to the feeding signal 1001.

The second radiating element 1020 is electrically connected to a ground plane, and surrounds the coupling portion 1011 to form the first coupling gap D101 and the second coupling gap D102. For example, the second radiating element 1020 includes a plurality of bends, so as to form a first segment 1020A to a fourth 1020D connected in series. The first segment 1020A is electrically connected to the ground plane. The second segment 1020B and the coupling portion 1011 are separated by the first coupling gap D101. The third segment 1020C is electrically connected between the second segment 1020B and the fourth segment 1020D. The fourth segment 1020D and the coupling portion 1011 are separated by the second coupling gap D102.

The switchover element 1030 is electrically connected between the first radiating element 1010 and the second radiating element 1020, and determines whether to conduct the first radiating element 1010 and the second radiating element 1020 according to a control signal. For example, the switchover element 1030 may be the switching element including two terminals, and the two terminals of the switching element are electrically connected to the first radiating element 1010 and the second radiating element 1020. Furthermore, the switching element determines whether to conduct the two terminals according to the control signal, and then the first radiating element 1010 can be selectively conducted to the second radiating element 1020 via the switchover element 1030.

If the switchover element 1030 makes the first radiating element 1010 conduct to the second radiating element 1020, the tunable antenna 1000 forms an inverted-F antenna by feeding directly, and the first resonant mode is generated. If the switchover element 1030 does not conduct the first radiating element 1010 and the second radiating element 1020, the first radiating element 1010 generates the second resonant mode through the exciting of the feeding signal 1001. The feeding signal 1001 from the first radiating element 1010 is coupled to the second radiating element 1020 via the first coupling gap D101 and the second coupling gap D102, and then the tunable antenna 1000 generates the third resonant mode.

If the switchover element 1030 does not conduct the first radiating element 1010 to the second radiating element 1020, the tunable antenna 1000 uses the coupling feeding mode to generate the second resonant mode and the third resonant mode via the first radiating element 1010 and the second radiating element 1020, respectively. In other words, the tunable antenna 100 selects the feeding mode of the antenna via the switchover element 1030. Thus, the tunable antenna 100 is miniaturized, and it also can operate at broadband and multiband.

In conclusion, the switch circuit or the switchover element is used for selecting the feeding mode of the antenna, and the resonant path of the radiation portion of the second radiating element also can be adjusted via the connection circuit. Thus, the tunable antenna can generate a plurality of resonant modes, so as to operate at broadband and multiband.

Although the invention has been disclosed with reference to certain preferred embodiments thereof, the disclosure is not for limiting the scope. Persons having ordinary skill in the art may make various modifications and changes without departing from the spirit and the scope of the invention. Therefore, the scope of the appended claims should not be limited to the description of the preferred embodiments described above.

What is claimed is:

1. A tunable antenna, comprising:

a first radiating element including a coupling portion and a first feeding portion;

a second radiating element including a second feeding portion, a grounding portion and a radiation portion, wherein the grounding portion is electrically connected to a ground plane, and the radiation portion surrounds the coupling portion to form a first coupling gap and a second coupling gap;

a connection circuit electrically connected to the radiation portion, wherein a state of the connection circuit is changed via a control signal to adjust a length of the resonant path of the radiation portion; and a switch circuit capable of transmitting a feeding signal to the first feeding portion or the second feeding portion, wherein the radiation portion includes a plurality of bends to form a plurality of segments, and the segments includes a first segment and a second segment which are parallel to each other, the first segment and the coupling portion are separated by a first coupling gap, and the second segment and the coupling portion are separated by a second coupling gap.

2. The tunable antenna according to claim 1, wherein the segments further includes a third segment which is parallel to the second segment, the third segment is electrically connected between the second feeding portion and the grounding portion, and the connection circuit is electrically connected between the second segment and the third segment, whether the second segment and the third segment are conducted according to the control signal.

3. The tunable antenna according to claim 2, wherein if the switch circuit transmits the feeding signal to the second feeding portion, the connection circuit does not conduct the second segment and the third segment, the tunable antenna generates a first resonant mode via the second radiating element, if the switch circuit transmits the feeding signal to the first feeding portion, the connection circuit conducts the second segment and the third segment, the tunable antenna generates a second resonant mode and a third resonant mode via the first radiating element and the second radiating element, respectively.

4. The tunable antenna according to claim 1, wherein the second segment is electrically connected to the second feeding portion and the grounding portion, and the connection circuit is inserted in the second segment.

5. The tunable antenna according to claim 4, wherein the connection circuit comprises:

a switching element; and a coupling element connected to the switching element in parallel.

6. The tunable antenna according to claim 5, wherein the coupling element is a passive element.

7. The tunable antenna according to claim 5, wherein if the switch circuit transmits the feeding signal to the second feeding portion, the switching element is not conducted, and then the tunable antenna generates a first resonant mode via the second radiating element and the coupling element, if the switch circuit transmits the feeding signal to the first feeding portion, the switching element is conducted, and then the tunable antenna generates a second resonant mode and a third resonant mode via the first radiating element and the second radiating element, respectively.

8. The tunable antenna according to claim 1, wherein the segments further includes a third segment which is electrically connected to the first segment, the second segment is electrically connected to the second feeding portion and the grounding portion, the connection circuit is electrically connected between the third segment and the first feeding portion, whether the second segment and the third segment is conducted according to the control signal.

9. The tunable antenna according to claim 8, wherein if the switch circuit transmits the feeding signal to the second feeding portion, the connection circuit conducts the first radiating element and the second radiating element, and thus the tunable antenna extends a length of the resonant path via the first radiating element, and the tunable antenna generates a first resonant mode via the first radiating element and the second radiating element, if the switch circuit transmits the feeding signal to the first feeding portion, the connection circuit does not conduct the first radiating element and the second radiating element, and thus the tunable antenna generates a second resonant mode and a third resonant mode via the first radiating element and the second radiating element, respectively.

10. The tunable antenna according to claim 1, wherein if the switch circuit transmits the feeding signal to the first feeding portion, the feeding signal from the first radiating element is coupled to the second radiating element via the first coupling gap and the second coupling gap.

11. The tunable antenna according to claim 1, wherein the first radiating element is L-shaped or T-shaped.

12. The tunable antenna according to claim 1, further comprising:

a coupling element electrically connected between the second feeding portion and the switch circuit, wherein an impedance matching of the second feeding portion and the switch circuit is adjusted.

13. The tunable antenna according to claim 12, wherein the coupling element a passive element.

14. A tunable antenna, comprising:

a first radiating element including a coupling portion and a first feeding portion, wherein the first feeding portion is electrically connected to a feeding signal;

a second radiating element electrically connected to a ground plane and surrounding the coupling portion to form a first coupling gap and a second coupling gap; and a switchover element electrically connected between the first radiating element and the second radiating element, wherein whether the first radiating element and the second radiating element are conducted according to a control signal, wherein the second radiating element including a plurality of bends to form a first segment to a fourth segment, wherein the first segment is electrically connected to the ground plane, the second segment and the coupling portion are separated by the first coupling gap, the fourth segment and the coupling portion are separated by the second coupling gap.

15. The tunable antenna according to claim 14, wherein if the switchover element conducts the first radiating element and the second radiating element, the tunable antenna forms an inverted-F antenna.

* * * * *